US005873136A

United States Patent [19]

Geeham

[11] Patent Number: 5,873,136

[45] Date of Patent: Feb. 23, 1999

[54] POP-UP BOWL VALVE FOR TOILET WITH TWO FLUSH MODALITIES

[76] Inventor: Calvin T. Geeham, 12761 138th La. N., Largo, Fla. 34644

[21] Appl. No.: 972,292

[22] Filed: Nov. 18, 1997

[51] Int. Cl.[6] ..... E03D 11/10

[52] U.S. Cl. ..... 4/434; 4/252.5; 4/324; 4/326; 4/363; 4/364; 4/405; 4/411; 4/413; 4/684

[58] Field of Search ..... 4/249, 252.4, 252.5, 4/324, 325, 326, 363, 364, 405, 406, 411, 412, 413, 414, 434, 441, 442, 684, 287, 293, 471, 650, 682

[56] References Cited

U.S. PATENT DOCUMENTS

| | | | |
|---|---|---|---|
| 209,870 | 11/1878 | Demarest | 4/441 |
| 863,778 | 8/1907 | Brooks | 4/441 |
| 1,474,288 | 11/1923 | Rath | 4/326 |
| 1,805,204 | 5/1931 | Brown | 4/326 |
| 2,514,040 | 7/1950 | Eksergian | 4/434 |
| 2,929,073 | 3/1960 | Sarlin | 4/249 X |
| 3,344,439 | 10/1967 | Davies | 4/363 X |
| 3,654,641 | 4/1972 | Braun, Sr. | 4/256.1 |
| 3,877,082 | 4/1975 | Wilhelm | 4/326 |
| 4,987,616 | 1/1991 | Ament | 4/421 |
| 5,090,066 | 2/1992 | Schoepe et al. | 4/378 |
| 5,201,082 | 4/1993 | Rockwell | 4/434 X |
| 5,548,850 | 8/1996 | Geeham | 4/326 |

FOREIGN PATENT DOCUMENTS

| | | | |
|---|---|---|---|
| 742836 | 9/1966 | Canada | 4/684 |

OTHER PUBLICATIONS

Toilet Catalog of Kohler Co., Kohler WI 53044, 1992.

Kohler Service Parts List for Wellworth Lite Toilet of Kohler Co. Kohler WI 53044, Jan. 1993.

Hushflo Fill Valve Instruction Sheet of Plumb Shop, Southfield, MI 48034, Dated 1992.

Fluidmaster Toilet Tank Repair Valve Information on Product Box of Fluidmaster, Inc. Anaheim CA 92803.

Fluidmaster Toilet Tank Repair Valve Product Instruction Literature of Fluidmaster, Inc. Anaheim CA 92803.

Touch Flush Assembly Product Box Literature of Lavelle Ind. Burlington, WI 53105 Date Unknown but Believed Before Jan. 1994.

"Wax Toilet Bowl Mounting Ring" Packaging of Plumb Shop, Southfield, MI 48034 Dated 1992.

"Pop–Up Basin Drain" Packaging of Jameco Industries, Inc. Spindale, NC 28160 Undated, but Similar Products on Market for Many Years.

Conventional Toilet Drain Connector—Undated but on Market for Many Years.

*Primary Examiner*—David J. Walczak
*Assistant Examiner*—Tuan N. Nguyen
*Attorney, Agent, or Firm*—Peter D. Keefe

[57] ABSTRACT

A two flush modality toilet composed of a bowl, a tank connected with the bowl wherein the tank is connected to a water supply, a conventional flush modality for flushing solid waste from the bowl, and a urinal flush modality for flushing liquid only waste from the bowl, wherein the urinal flush modality includes: a bowl valve in the form of a pop-up stopper, pop-up seat and pivot ball assembly at the low point of the bowl; a bowl valve control for selecting between open and closed states of the bowl valve, a passageway for directing liquid waste from the bowl into the sanitary drain; and an auxiliary flush control for supplying a limited quantity of flush water from the tank into the bowl to provide restoration of the trap water in the bowl after a urinal flush modality liquid drainage of the bowl has occurred. A foot pedal selectively operates the bowl valve, wherein when in an open state all the liquid in the bowl is drained. Upon release of the foot pedal, the bowl valve is returned to the closed state. A limited amount of flush water from the tank is then delivered to the bowl to restore the trap water.

14 Claims, 3 Drawing Sheets

POP-UP BOWL VALVE FOR TOILET WITH TWO FLUSH MODALITIES

BACKGROUND OF THE INVENTION

1. Field of the Invention

The present invention relates to toilets having two flush modalities, wherein one flush modality is a urinal flush modality. More particularly, the present invention relates to a bowl valve for the urinal flush modality in the form of a pop-up valve. Still more particularly, the present invention relates to a toilet having two-flush modalities wherein urinal flush piping has a minimized cross-sectional height.

2. Description of the Prior Art

Toilets serve admirably as an efficient and sanitary means to dispose of waste material. Toilets operate upon a flush cycle, wherein waste disposal is performed with the accompaniment of a large quantity of water, usually on the order of three, four or more gallons.

As population densities have increased, the demands upon available water supplies have become quite substantial. Indeed, periodically, certain locales are subject to water rationing, wherein flushing of the toilet is requested to be performed only infrequently. Such a request not only subjects the toilet user to odor, but potentially also to disease due to the stagnancy of pre-used bowl water. Accordingly, a solution to the water demands of toilet flushing with each toilet use would be extremely desirable for both personal and ecological reasons.

One "popular" notion to reduce the amount of f lush water needed is to place an object in the tank, such as a water filled plastic milk container, the volume of which diminishing the water volume in the tank. While this sounds not only feasible but practical, one must consider why, in the first place, the toilet manufacturer designed the tank to hold a specified amount of flush water. First, there must be enough flush water to move solid waste in the bowl out of the toilet and into the sanitary drain. Second, there must be still more flush water to flush out the dirty bowl water while at the same time rinsing the bowl clean. Thirdly, there must be enough flush water left over to provide an adequate depth of water at the trap located at the bottom portion of the bowl so that the sanitary drain is fluidicaily cut-off from the bowl to thereby prevent methane and other sewer gases from backing-up into the bowl, and, thereupon, into the restroom. Thus, reducing the amount of flush water by simply reducing the water stored in the tank may result in insufficient water to properly flush the bowl. More potentially disastrous, is that over time an accumulation of solid waste may become lodged in the sanitary drain, plugging the drain and resulting in back-ups because repeatedly too little flush water was available to move the solid waste out the local sanitary drain and into the main sanitary drain.

Some toilets operate on a flush process wherein less flush water is required, such as described in U.S. Pat. No. 4,987,616 to Ament, dated Jan. 29, 1991. Other toilets combine a lesser amount of flush water in combination with a compressed gas principle. Problematically, these toilets may be subject to drain clogging if insufficient flush water is available to move the flushed solid waste out into the main sanitary drain.

The flushing of liquid waste requires less flush water than does the flushing of solid waste, since the flushing of liquid waste does not entail the potential for drain clogging. With this concept in mind, the present inventor devised a toilet with two flush modalities, now described in U.S. Pat. No. 5,548,850, issued on Aug. 27, 1996, which patent is hereby herein incorporated by reference, wherein described is a toilet which operates on the basis of two flush modalities: one for flushing solid waste, and a second for flushing only liquid waste.

The two flush modality toilet according to U.S. Pat No. 5,548,850 is composed of a bowl, a tank connected with the bowl wherein the tank is connected to a water supply, a conventional flush modality for flushing solid waste from the bowl, and a urinal flush modality for flushing liquid only waste from the bowl, wherein the urinal flush modality includes: a bowl valve at the base of the bowl, a bowl valve control for selecting between open and closed states of the bowl valve, a conduit for directing liquid waste from the bowl into the sanitary drain, and an auxiliary flush control for supplying a limited quantity of flush water from the tank into the bowl to provide restoration of the trap water in the bowl after a urinal flush modality has been initiated.

A foot pedal selectively operates the bowl valve, wherein when in an open state all the liquid in the bowl is drained. Upon release of the foot pedal, the bowl valve is returned to a closed state. Flush water from the tank is then delivered to the bowl to restore the trap water.

Operation may be mechanically effected or electronically effected. With regard to mechanical operation, the flush water from the tank may be introduced by action of the foot pedal or by separate action of a control at the tank.

While the above described two flush modality toilet is admirably able to do the job intended, there is improvement needed. For example, the bowl valve described therein is in the form of a bowl stopper which sealingly engages a bowl valve seat, wherein the bowl valve is opened by moving the bowl stopper descendingly away from the bowl and the bowl seat. As a result, sealing may not be assured, in that the weight of the water in the toilet bowl presses down on the bowl stopper, tending to unseal it in relation to the bowl seat. Further, the cross-sectional height of the plumbing associated with the urinal flush modality as described therein is potentially too large to be truly practical.

Accordingly, what is needed is a two flush modality toilet wherein the bowl valve is simple and reliable and the urinal flush plumbing has minimal cross-sectional height.

SUMMARY OF THE INVENTION

The present invention is a two flush modality toilet wherein the bowl valve is simple and reliable and the urinal flush plumbing has minimal cross-sectional height.

The bowl valve according to the present invention is in the form of a pop-up valve wherein a pop-up stopper sealingly rests upon a pop-up seat to close the bowl valve, and wherein the pop-up stopper raises in relation to the pop-up seat to open the bowl valve. The associated linkage between the pop-up stopper and a foot pedal is structured to provide a minimized vertical cross-sectional height.

The plumbing associated with the urinal flush modality, including the pop-up valve body, passageway and drain connection thereof have a minimized vertical cross-sectional height. In this regard, the flange of the floor drain connector is preferred to be slotted at the entry of the interconnection of the passageway and the drain connection. In this regard further, a wax seal thereat is also preferred to have a commensurate opening for receiving the passageway. Accordingly, the vertical cross-sectional height of the plumbing for the urinal flush modality is minimized so that a toilet so equipped is kept generally within conventional toilet dimensionalities.

Accordingly, it is an object of the present invention to provide a toilet having two flush modalities, wherein the bowl valve thereof is in the form of a pop-up valve.

It is another object of the present invention to provide a toilet having two flush modalities wherein the vertical cross-sectional height is minimized.

These, and additional objects, advantages, features and benefits of the present invention will become apparent from the following specification.

DETAILED DESCRIPTION OF THE PREFERRED EMBODIMENTS

Figure 1:
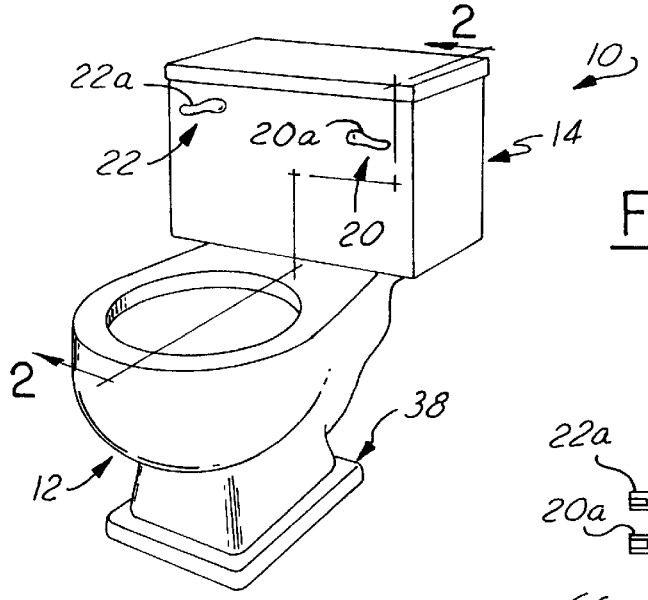
FIG. 1 is a perspective view of a toilet with two flush modalities featuring the improvements according to the present invention.
Figure 2:
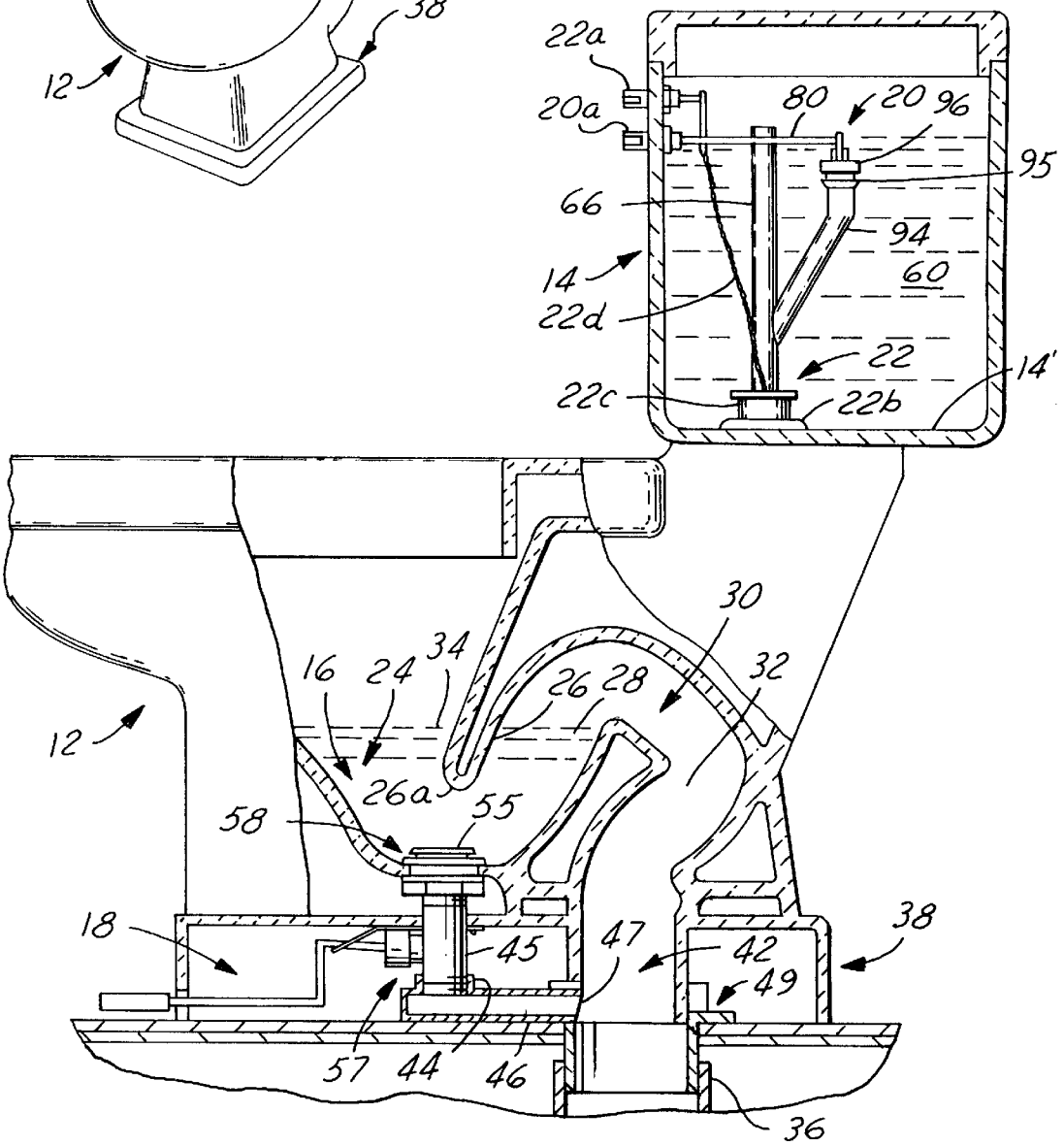
FIG. 2 is a partly sectional side view of the toilet having two flush modalities, seen along line 2—2 of FIG. 1.

Ref erring now to FIGS. 1 and 2, a two flush modality toilet 10 according to the present invention is depicted. The two flush modality toilet 10 includes a bowl 12, a tank 14, a bowl valve 16 in the form of a pop-up valve including a pop-up stopper 55 and a pop-up seat 58 therefor, a bowl valve control 18, and an auxiliary flush control 20 at the tank. The tank 14 is connected with an external source of pressurized potable water via a supply pipe (not shown) in a conventional manner well known in the art. The structure and function for providing actuation of the conventional flush modality is determined conventionally by operation of a conventional flush control 22 including: a conventional flush lever 22*a*, a conventional flush feed 22*b* for supplying flush water from the tank to the bowl, a conventional float stopper 22*c* connected by a linkage 22*d* for selectively sealing the conventional flush feed, and a conventional tank water height sensing water inflow valve which is connected to the supply pipe (not shown) for refilling the tank with flush water. Preferably, the conventional tank water height sensing water inflow valve is of the kind without a ball-float and rod-arm, as these components could make the tank interior too crowded to allow for the auxiliary flush control, as for example the FLUIDMASTER (a registered trademark) Model 400A fill valve manufactured by Fluidmaster, Inc. of Anaheim, Calif. 92803. (See FIG. 3 of herein incorporated U.S. Pat. 5,5,48,850.)

The bowl 12 includes a trap 24 defined by a depending projection 26, an upleg portion 28 of the bowl outlet 30, and a downleg portion 32 of the bowl outlet. The upleg and downleg portions 28, 32 are of a generally inverted U-shape, wherein the upleg portion defines in part the bottom portion of the bowl 12. The height of the upleg portion 28 is higher than the location of the terminous 26*a* of the depending projection 26. Accordingly, when water 34 fills the trap 24 at the bottom portion of the bowl 12 to a height approximated by the height of the upleg portion 28, the water immerses the terminous 26*a* of the depending projection 26, thereby sealing-off the bowl from the drain 36. The trap 24 has a low point whereat the bowl valve 16 is located; accordingly, when the bowl valve is opened all the liquid in the trap will drain therethrough.

In operation, when a user has completed using the two flush modality toilet 10 the user selects the flush modality. If solid (and/or liquid) waste is present in the bowl 12, the user selects the conventional flush modality by pressing the conventional flush lever 22*a*. If only liquid waste is present in the bowl 12, the user may select (as an alternative to selecting the conventional flush modality) a urinal flush modality by actuating the bowl valve 16 to thereby drain the liquid waste from the bowl and actuating the auxiliary flush control 20 via a urinal flush lever 20*a* to thereby restore the water at the trap 24 of the bowl 12.

The structure and function for carrying out the two flush modality toilet 10 will be detailed hereinbelow with reference being additionally directed to remaining FIGS. 3 through 10.

A base 38 is provided, preferably integral with the bowl 12. Alternatively the base 38 could be a separate piece as for example constructed of plastic, which forms a platform upon which the toilet proper is situated. As shown in FIG. 2, and as can be appreciated by comparative reference to FIG. 1, the base 38 is provided with a drain channel 42. The drain channel 42 is aligned with the downleg portion 32 of the bowl outlet 30. A tailpiece 44 is threadably engaged with a pop-up valve body 45 (which is, in turn, threadably engaged with the aforementioned pop-up seat 58). Consequently, when the conventional flush modality is selected, flushing discharge from the bowl 12 exits the bowl outlet 30, goes into the drain channel 42 and into the drain 36. Consequently further, when the urinal flush modality is selected, the liquid in the trap 24 drains out the bowl valve 16, goes through the the pop-up valve body 45, enters into the tailpiece 44, passes through a passageway 46, and then enters into the drain 36 via an entry port 47 at the drain channel 42.

As mentioned, the bowl valve is in the form of a pop-up valve, wherein numeral 16 refers commonly to either term for this component. The pop-up stopper 55, the pop-up seat 58, and a pivot ball assembly 57 are of a generally known construction as conventionally used for bathroom sinks. The pivot ball assembly 57 is shown best at FIGS. 3 and 4. The pop-up stopper 55 has an extension member 55*a* which hooks onto a, pivot rod 59. The pivot rod 59 passes through a pivot ball 61 and then exits the pivot ball assembly 57. The pivot ball 61 is rotatably seated in sealing relation with a ball socket 63 formed in the pivot seal assembly 57. Accordingly, pivoting of the pivot rod 59 at the pivot ball 61 results in the pop-up stopper moving up and down in relation to the pop-up valve body 45. Since the pop-up valve body 45 is threadably engaged with the pop-up seat 58, and since the pop-up seat is sealingly engaged, such as via a gasket and nut threaded on the stopper seat, with the toilet bowl 12 about a drainage hole 15 formed therein at its lowest point, the vertical movement of the pop-up stopper 55 controls whether or not the bowl 12 is able to hold water 34 in the trap 24.

The bowl valve control 18 is composed of a foot pedal 50 which is connected to the pivot rod 59, and a biasing spring 54 connected, as for example with an interior partition wall. The biasing spring 54 biases the pivot rod 59 so that the pop-up stopper 55 is normally in sealing engagement with the pop-up seat 58, wherein the bowl (pop-up) valve 16 is normally in the closed state unless the foot pedal 50 is depressed by a user.

Figure 3:
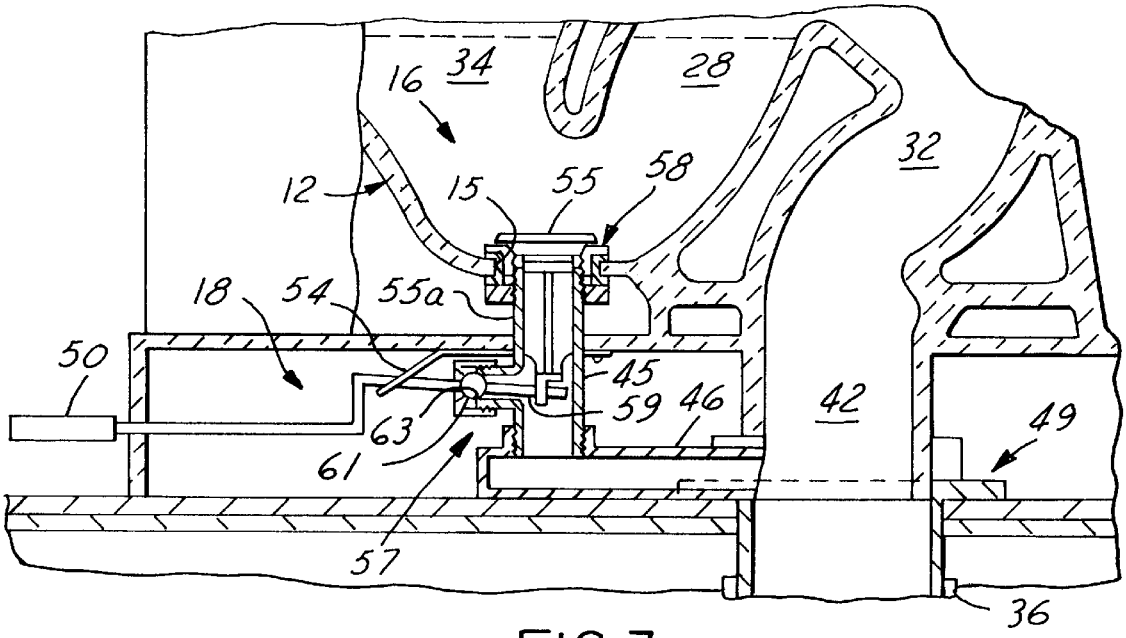
FIG. 3 is a partly sectional side view of the toilet having two flush modalities, wherein the bowl valve is shown in the closed state.
Figure 4:
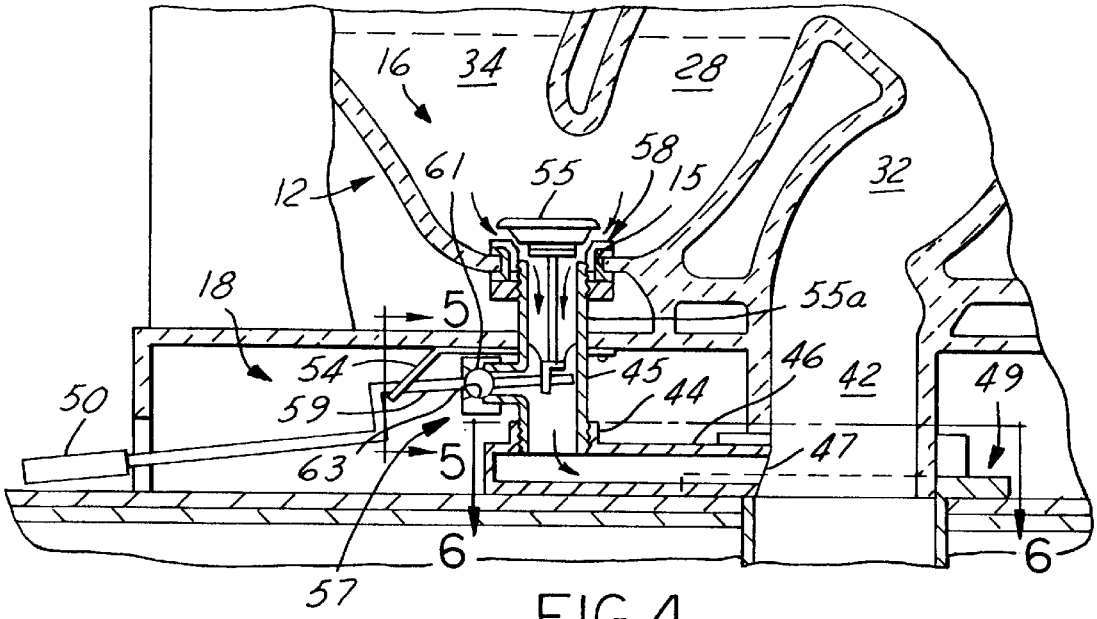
FIG. 4 is a partly sectional side view of the toilet having two flush modalities, wherein the bowl valve is shown in the open state.
Figure 5:
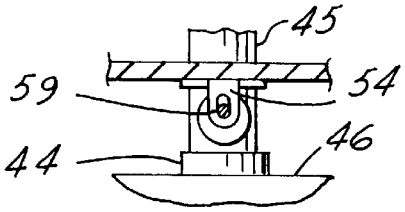
FIG. 5 is a partly sectional view along line 5—5 of FIG. 4, showing in particular the pivot ball assembly of the pop-up type of bowl valve.
Figure 6:
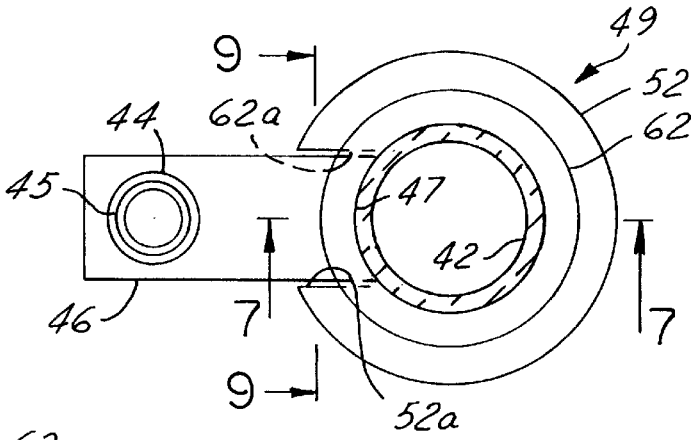
FIG. 6 is a partly sectional top plan view of the drain connection of the urinal flush modality plumbing of the toilet of FIG. 1, seen along line 6—6 of FIG. 4.
Figure 7:
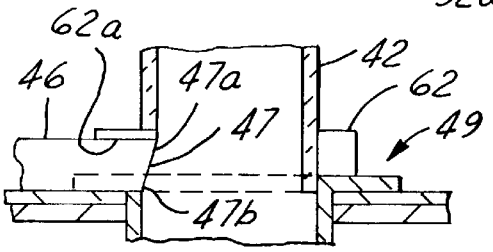
FIG. 7 is a partly sectional view along line 7—7 of FIG. 6.
Figure 8:
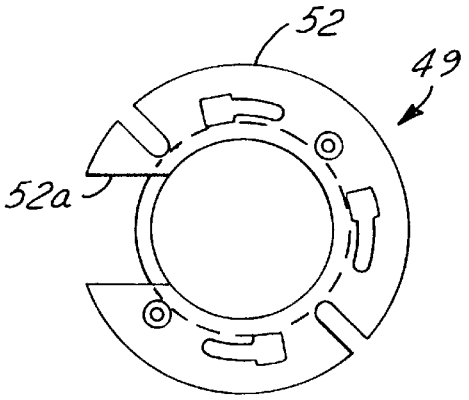
FIG. 8 is a top plan view of a slotted flange of a floor drain connector according to the present invention.
Figure 9:
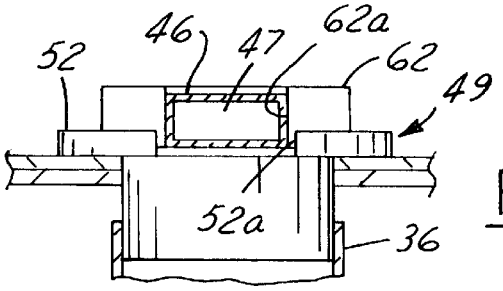
FIG. 9 is a partly sectional view along line 9—9 of FIG. 6.

In operation, as shown in FIGS. 3, 4 and 5, when the foot pedal 50 is depressed to a down position against biasing of the biasing spring 54 (FIG. 4), the pivot rod 59 pivots and pushes the pop-up stopper 58 upwardly away from the pop-up seat 58 and into the bowl 12, wherein the bowl valve 16 is in the open state (FIG. 4). Now, whatever liquid is in the bowl will drain in accordance with the above recounted urinal flush modality through the bowl valve and, as recounted, into the drain 36. Upon release of the foot pedal 50, the biasing of the biasing spring 54 will cause the foot pedal to rise to an up position (FIG. 3) and the pop-up stopper 55 of the bowl valve 16 to move downwardly and reseat in sealing relation with respect to the pop-up seat 58, wherein the bowl valve is returned to the closed state (FIG. 3) and water is able to be held in the trap.

In order that the proper amount of flush water is introduced into the bowl 12 depending upon the selected flush modality, the tank 14 is equipped with two flush controls: a conventional flush control 22 and an auxiliary flush control 20.

When the conventional flush modality is selected, the conventional flush lever 22*a* is turned, separating the float stopper 22*c* from the conventional flush feed 22*b* in a conventional manner, wherein new water will enter into the tank from the external water line via the conventional tank water height sensing water inflow valve. Flush water 60 from the tank 14 will enter into the bowl 12 conventionally and exit the bowl outlet 30 as described hereinabove. After the flush water 60 is exhausted, the conventional float stopper 22*c* sealingly seats on the conventional flush feed 22*b*, and the conventional tank water height sensing water inflow valve within the tank will turn off the incoming water when the tank water reaches its predetermined height.

When the urinal flush modality is selected, it is desired to only supply enough water to the bowl 12 to refill the trap 24; approximately one quart is sufficient for this purpose. In order that not all the tank water is flushed into the bowl 12 after the foot pedal 50 is depressed and released, even though the tank flush water is, itself, used, it is used only to a limited depth. To accomplish this, the auxiliary flush control 20 has an overflow tube 66 modified to accept connection with an auxiliary flush tube 94. The auxiliary flush tube 94 connects to the overflow tube 66 somewhat near the bottom of the tank 14' and emanates therefrom at an acute angle, then bends into a vertical orientation that is parallel with the overflow tube 66. The end of the auxiliary flush tube 94 is provided with a stopper seat 95 for an auxiliary float stopper 96 to seal against. The auxiliary float stopper 96 is pivotally connected to the overflow tube 66, as for example by a studded ring mounted thereupon. The auxiliary float stopper 96 is connected with an auxiliary linkage 80 which is in turn connected to the auxiliary control lever 20*a*. As shown in FIG. 1, the height of the stopper seat 95 is located a predetermined distance beneath the preset fill height of the flush water in the tank 14 so that substantially the amount of water needed to fill the trap 24 is above the stopper seat 95 and exits the tank (inclusive of whatever new water enters into the tank via the conventional tank water height sensing water inflow valve during exiting of water through the auxiliary flush tube), more-or-less about one gallon of water. An example of a known product that could be used as an auxiliary float stopper (perhaps with some modification) is a Touch Flush Assembly, product no. 628P of Lavelle Industries, Inc. of Burlington, Wis. 53105.

In operation, after the foot pedal 50 has been depressed and then released thereby opening, draining and re-closing the trap 24, the auxiliary float stopper 96 is raised, via the auxiliary flush linkage 80, by pressing the auxiliary flush lever 20*a*. New water will enter into the tank 14 via the conventional tank water height sensing water inflow valve until the preset height of flush water in the tank is reached, whereupon the tank will be refilled.

The preferred drain connection aspects are depicted most clearly in FIGS. 6 through 9.

As mentioned, the passageway 46 terminates into the drain channel 42 (which may be considered a portion of the bowl outlet 30) at the entry port 47. In this regard in order to minimize cross-sectional height, the flange 52 of the drain connector 49 has a slot 52*a* for receiving therethrough the passageway 46. It is preferred for the entry port 47 to have a overhanging upper side 47*a* in relation to the lower side 47*b*, as shown best at FIG. 7, in order to facilitate waste movement through the drain channel 42 without tendency to enter into the passageway 46.

A wax ring 62 is provided to seal the passageway 46 and drain channel 42 with respect to the drain connector 49. In this regard it is preferred for the wax seal 62 to be provided with an opening 62*a*, such as a cut-out, into which the passageway is received. The passageway 46 is sealed with respect to the drain channel 42, which seal may be provided via seals in addition to the wax ring 62, such as for example plumber's putty or a resilient gasket.

Figure 10:
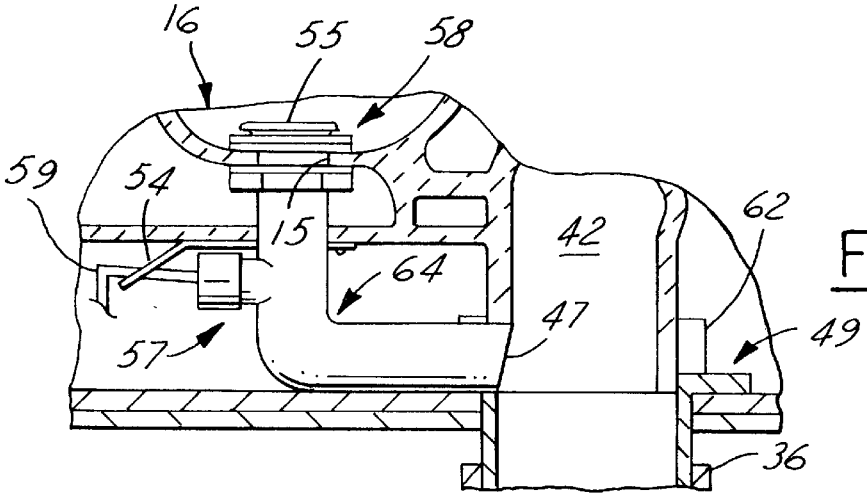
FIG. 10 a partly sectional side view of the toilet having two flush modalities, particularly showing alternative plumbing of the urinal flush modality.

FIG. 10 depicts a modification of the toilet with two flush modalities according to the present invention, wherein the modification resides in the aforementioned passageway (which is preferably square or rectangularly cross-sectioned) and pop-up valve body being combined into a pop-up valve elbow 64 having the aforementioned entry port 47.

To those skilled in the art to which this invention appertains, the above described preferred embodiment may be subject to change or modification. For example, the disclosure herein, which is preferred, may be modified to include any of the embodiments disclosed in herein incorporated U.S. Pat. No. 5,548,850. Such change or modification can be carried out without departing from the scope of the invention, which is intended to be limited only by the scope of the appended claims.

What is claimed is:

1. A toilet having two flush modalities, the toilet being structured for connecting to a drain and to a source of pressurized water, the toilet comprising:

a bowl having a trap formed therein for holding liquid, said trap having a low point, said bowl having a bowl outlet connected with said trap, said bowl having a drainage hole at said low point;

conventional flush modality means for selectively delivering water into said bowl to thereby flush said bowl and to refill said trap with water; and urinal flush modality means comprising:

a bowl valve comprising:

a pop-up seat sealingly connected with said bowl at the drainage hole thereof;

a pop-up stopper seatably enagageable with said pop-up seat, said pop-up stopper being movable between a sealingly seated position on said pop-up seat to an open position wherein said pop-up stopper is located a predetermined distance into said bowl away from said pop-up seat; and pivot ball assembly means connected to said pop-up stopper for effecting movement of said pop-up stopper between said seated and open positions thereof;

bowl valve control means connected with said pivot ball assembly means for selecting said open and seated positions of said pop-up stopper;

passageway means connected with said pop-up seat for providing a liquid passageway between said pop-up seat and said bowl outlet; and auxiliary flush control means for selectively delivering a predetermined amount of water to said bowl to thereby refill said trap with water when said pop-up stopper is in said seated position.

2. The toilet having two flush modalities of claim 1, further comprising drain connection means for connecting said bowl outlet to a drain; wherein said drain connection means comprises:

said bowl outlet further comprising a drain channel; and a drain connector for connecting said drain channel to a drain, said drain connector having a flange, said flange having a slot;

wherein said passageway means is received into said slot, and wherein said passageway means has an entry port which fluidically communicates with said drain channel.

3. The two flush modality toilet of claim 2, wherein said entry port has an upper side and an opposite lower side, wherein said upper side overhangs said lower side with respect to said drain channel.

4. The two flush modality toilet of claim 3, wherein drain connection means further comprises a wax ring, said wax ring having an opening, said opening receiving said passageway means.

5. A toilet having two flush modalities, the toilet being structured for connecting to a drain and to a source of pressurized water, the toilet comprising:

a tank having an overflow tube;

conventional flush control means connected with said tank for filling said tank with a preselected amount of water derived from a source of pressurized water;

a bowl connected with said tank, said bowl having a trap formed therein for holding liquid, said trap having a low point, said bowl having a drainage hole at said low point, wherein the overflow tube is connected with said bowl;

conventional flush modality means connected with said tank for selectively delivering water in said tank into said bowl to thereby flush said bowl through said drainage hole and to refill said trap with water; and urinal flush modality means comprising:

a bowl valve comprising:

a pop-up seat sealingly connected with said bowl at the drainage hole thereof;

a pop-up stopper seatably enagageable with said pop-up seat, said pop-up stopper being movable between a sealingly seated position on said pop-up seat to an open position wherein said pop-up stopper is located a predetermined distance into said bowl away from said pop-up seat; and pivot ball assembly means connected to said pop-up stopper for effecting movement of said pop-up stopper between said seated and open positions thereof;

bowl valve control means connected with said pivot ball assembly means for selecting said open and seated positions of said pop-up stopper;

drain connection means for connecting said drainage hole to a drain;

passageway means connected with said pop-up seat for providing a liquid passageway between said pop-up seat and said drain connection means; and auxiliary flush control means for selectively delivering a predetermined amount of water to said bowl to thereby refill said trap with water when said pop-up stopper is in said seated position.

6. The two flush modality toilet of claim 5, wherein said bowl valve control means comprises:

a foot pedal movable with respect to said bowl from an up position to a down position;

connection means for connecting said foot pedal with said pivot ball assembly means, wherein movement of said pop-up stopper between said seated and open positions is responsive to movement of said foot pedal between said up and down positions; and biasing means connected with said connection means for biasing said foot pedal to said up position.

7. The two flush modality toilet of claim 6, wherein said auxiliary flush control means comprises:

an auxiliary flush tube connected with the overflow tube, wherein said auxiliary flush tube has an open end located at a predetermined location in said tank wherein an amount of water above said open end which is determined by said tank fill means substantially is said predetermined amount of water;

float stopper means for selectively sealing said open end of said auxiliary flush tube; and float stopper control means for selectively releasing said float stopper means from sealing engagement with said open end to thereby cause water in said tank to enter into the overflow tube.

8. The two flush modality toilet of claim 7, wherein said drain connection means comprises:

a drain channel connected with said bowl outlet; and a drain connector for connecting said drain channel to a drain, said drain connector having a flange, said flange having a slot;

wherein said passageway means is received into said slot, and wherein said passageway means has an entry port which fluidically communicates with said drain channel.

9. The two flush modality toilet of claim 8, wherein said entry port has an upper side and an opposite lower side, wherein said upper side overhangs said lower side with respect to said drain channel.

10. The two flush modality toilet of claim 9, wherein drain connection means further comprises a wax ring, said wax ring having an opening, said opening receiving said passageway means.

11. The two flush modality toilet of claim 5, wherein said drain connection means comprises:

a drain channel connected with said bowl outlet; and a drain connector for connecting said drain channel to a drain, said drain connector having a flange, said flange having a slot;

wherein said passageway means is received into said slot, and wherein said passageway means has an entry port which fluidically communicates with said drain channel.

12. The two flush modality toilet of claim 11, wherein said entry port has an upper side and an opposite lower side, wherein said upper side overhangs said lower side with respect to said drain channel.

13. The two flush modality toilet of claim 12, wherein drain connection means further comprises a wax ring, said wax ring having an opening, said opening receiving said passageway means.

14. In a toilet having two flush modalities, the toilet being structured for connecting to a drain and to a source of pressurized water, the toilet having a bowl, the bowl having a trap formed therein for holding liquid, the trap having a low point, the bowl having a bowl outlet connected with the trap, the bowl having a drainage hole at the low point, an improvement thereto comprising:

a bowl valve comprising:

a pop-up seat sealingly connected with the bowl at the drainage hole thereof;

a pop-up stopper seatably enagageable with said pop-up seat, said pop-up stopper being movable between a sealingly seated position on said pop-up seat to an open position wherein said pop-up stopper is located a predetermined distance into the bowl away from said pop-up seat; and pivot ball assembly means connected to said pop-up stopper for effecting movement of said pop-up stopper between said seated and open positions thereof;

bowl valve control means connected with said pivot ball assembly means for selecting said open and seated positions of said pop-up stopper; and passageway means connected with said pop-up seat for providing a liquid passageway between said pop-up seat and the bowl outlet.

* * * * *